US009272833B2

(12) United States Patent
Wilmers et al.

(10) Patent No.: US 9,272,833 B2
(45) Date of Patent: Mar. 1, 2016

(54) PACKAGES FOR CONSUMABLE PRODUCTS

(71) Applicant: NESTEC S.A., Vevey (CH)

(72) Inventors: Kimberly Ann Wilmers, Twin Lake, MI (US); Simon Alexander Hutschenreuter, Grand Rapids, MI (US)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 14/363,798

(22) PCT Filed: Dec. 19, 2012

(86) PCT No.: PCT/EP2012/076215

§ 371 (c)(1),
(2) Date: Jun. 8, 2014

(87) PCT Pub. No.: WO2013/092751

PCT Pub. Date: Jun. 27, 2013

(65) Prior Publication Data

US 2015/0232250 A1 Aug. 20, 2015

Related U.S. Application Data

(60) Provisional application No. 61/577,259, filed on Dec. 19, 2011.

(51) Int. Cl.

| | |
|---|---|
| ***B65D 81/22*** | (2006.01) |
| ***A47G 23/06*** | (2006.01) |
| ***B65D 25/04*** | (2006.01) |
| ***B65D 81/28*** | (2006.01) |

(52) U.S. Cl.

CPC ..... *B65D 81/22* (2013.01); *A47G 23/06* (2013.01); *B65D 25/04* (2013.01); *B65D 81/28* (2013.01)

(58) Field of Classification Search

CPC ..... B65D 81/22; B65D 81/28; B65D 25/04; A47G 23/06

See application file for complete search history.

(56) References Cited

U.S. PATENT DOCUMENTS

| | | | | | |
|---|---|---|---|---|---|
| 4,346,813 | A * | 8/1982 | Cho et al. | ..... | 220/532 |
| 4,574,174 | A * | 3/1986 | McGonigle | ..... | 219/735 |
| 5,624,051 | A * | 4/1997 | Ahern et al. | ..... | 220/553 |
| 5,695,798 | A * | 12/1997 | Rozzano | ..... | 426/115 |
| 2002/0164404 | A1 * | 11/2002 | Gosselin et al. | ..... | 426/106 |

(Continued)

FOREIGN PATENT DOCUMENTS

| | | | |
|---|---|---|---|
| DE | 29823889 | U1 | 3/2000 |
| DE | 202009010873 | U1 | 10/2009 |

(Continued)

*Primary Examiner* — Viren Thakur
*Assistant Examiner* — Thanh H Nguyen
(74) *Attorney, Agent, or Firm* — Gary M. Lobel

(57) ABSTRACT

Packages (10) for storing, displaying and housing consumable products (18) without loss of product quality and methods of using same are provided. The packages (10) may be shallow enough to promote self-feeding while still allowing for upright display of the package (10). In a general embodiment, the packages (10) of the present disclosure include specific shapes, sizes and/or depths that provide complete coverage of consumable products (18) with sauces, preservatives, juices etc. (20) while still providing functional advantages to a consumer and/or user of such packages (10) who is learning to self-feed. In addition, the consumer product packages (10) having specific shapes, sizes and/or depths also provides for marketing and aesthetic advantages.

6 Claims, 2 Drawing Sheets

(56) References Cited

U.S. PATENT DOCUMENTS

| | | | | |
|---|---|---|---|---|
| 2009/0014348 | A1 | 1/2009 | Strange et al. | |
| 2012/0244265 | A1 * | 9/2012 | Turover et al. | 426/389 |

FOREIGN PATENT DOCUMENTS

| | | | | |
|---|---|---|---|---|
| FR | 1542959 | A | | 10/1968 |
| JP | 08294377 | A | * | 11/1996 |

* cited by examiner

PACKAGES FOR CONSUMABLE PRODUCTS

BACKGROUND

The present disclosure relates generally to packages. More specifically, the present disclosure relates to containers and trays for storing and displaying consumable products and methods of using same. Several aspects of storing and displaying packages containing consumable products may be discussed in the present disclosure including, but not limited to, protecting the consumable products, facilitating the consumption of the products, and providing several different configurations of the same package for retail display.

Packages for consumable products come in a variety of sizes, shapes, materials and designs. These sizes, shapes, materials and designs generally differ, for example, for aesthetic reasons or for marketing purposes. Consumable product packages having certain functional features, however, can provide advantages to a user of such packages in addition to possible aesthetic and marketing advantages.

Indeed, consumable product packages aimed to effectively store foods may not always provide optimal functionality or use during the consumption of the consumable product, particularly by individuals learning to self-feed. Packages deep enough to easily cover consumable products with sauces, flavorings, or preservatives when stored upright on a shelf are often too deep for toddlers or other individuals to use to self-feed. Shallow trays suitable for self-feeding, in contrast, may also not provide ideal surfaces or shapes for marketing and advertising purposes and may not sufficiently aid consumers in differentiating one product from another. Instead, consumable product packages having specific shapes, sizes and/or depths may provide complete coverage of consumable products with sauces, preservatives, juices etc. while still providing functional advantages to a consumer and/or user of such packages who is learning to self-feed. In addition, consumer product packages having specific shapes, sizes and/or depths also provide possible marketing and aesthetic advantages.

SUMMARY

The present disclosure is related to packages for housing consumable products. The packages may be shaped such that they facilitate or maintain preservation or flavor of consumable products kept in shallow compartments suitable for self-feeding, and increase purchase interest and marketability amongst consumers by maximizing space for graphics and billboard area on the package.

In an embodiment, a package is provided. The package includes a body defining an interior compartment configured to house a consumable product and a reservoir configured to house a substance capable of covering the consumable product when the package is placed in an upright position, and a substantially semicircular shaped protrusion separating the interior compartment and the reservoir.

In an embodiment, a height of the protrusion height is lower than a height of the body.

In an embodiment, the protrusion is formed integrally with the body. Alternatively, the protrusion is formed as a separate component attached to the body.

In an embodiment, the protrusion has a diameter that is from about 20% to about 50% less than a length of the body, or about 30% or less than a length of the body.

In an embodiment, the protrusion has a radius that is from about 5% to about 20% less than a height of the body, or is greater than about 20% of a height of the body.

In an embodiment, the protrusion extends an entire width of the body.

In an embodiment, the protrusion extends substantially the entire width of the body.

In an embodiment, the protrusion is configured for use as a grip.

In an embodiment, the package has only one protrusion.

In an embodiment, the protrusion divides the body through the center.

In an embodiment, the protrusion divides the body along a top third of the package.

In an embodiment, the body includes a plurality of gripping portions.

In an embodiment, the protrusion has a depth that is configured for gripping by a toddler. Alternatively, the protrusion may have a depth that is configured for gripping by a parent or caregiver.

In an embodiment, the body has a shape selected from the group consisting of a circle, square, rectangle, triangle, quadrilateral, pentagon, hexagon, heptagon, octagon, nonagon, decagon, hexadecagon, icosagon, star, ellipse, semicircle, crescent, flower, cylinder, cube, cuboid, pyramid, cone, prism, or combinations thereof. In an embodiment, the body is square shaped with rounded corners.

In an embodiment, the body is made from a material selected from the group consisting of plastic, cardboard, Styrofoam, metal, or combinations thereof.

In an embodiment, the body includes a perimeter. The perimeter forms a plane on which the package can stand.

In an embodiment, the consumable products are selected from the group consisting of pureed foods, hot dogs, fruit or vegetable pieces, meat, cheese, grains, pasta, or combinations thereof.

In an embodiment, the interior compartment has a shape selected from the group consisting of a circle, square, rectangle, triangle, quadrilateral, pentagon, hexagon, heptagon, octagon, nonagon, decagon, hexadecagon, icosagon, star, ellipse, semicircle, crescent, flower, cylinder, cube, cuboid, pyramid, cone, prism, or combinations thereof. In an embodiment, the interior compartment has a square shape with rounded corners.

In an embodiment, the interior compartment extends substantially an entire length of the body.

In an embodiment, the interior compartment extends substantially an entire width of the body.

In an embodiment, the interior compartment has a volume ranging from about 100 to about 180 cc, or from about 110 to about 170 cc, or from about 120 to about 160 cc, or from about 130 to about 150 cc. In an embodiment, the interior compartment has a volume of about 140 cc.

In an embodiment, the compartment is configured for self-feeding of a toddler.

In an embodiment, the reservoir has a shape selected from the group consisting of a circle, square, rectangle, triangle, quadrilateral, pentagon, hexagon, heptagon, octagon, nonagon, decagon, hexadecagon, icosagon, star, ellipse, semicircle, crescent, flower, cube, cuboid, prism, cylinder, cone, or combinations thereof. In an embodiment, the reservoir has a square shape with rounded corners.

In an embodiment, the reservoir extends substantially an entire length of the body.

In an embodiment, the reservoir extends substantially an entire width of the body.

In an embodiment, the reservoir is configured to hold at least one consumable product.

In an embodiment, the reservoir is configured for multiple uses. The multiple uses may include use as a storage area for a preservative and use as a serving area for a dipping sauce. The multiple uses may also include use as a storage area for brine and use as a serving area for condiments.

In an embodiment, the reservoir is configured to house a liquid selected from the group consisting of water, brine, pickling liquid, oil, juice, syrup, or combinations thereof. The reservoir may also be configured to house solids selected from the group consisting of salt, powdered spices, whole spice, sugar, or combinations thereof. In an embodiment, the reservoir is configured to house preservatives.

In an embodiment, the reservoir is configured to house a first substance during storage and a second substance during use by a consumer.

In an embodiment, the reservoir has a volume ranging from about 70 to about 130 cc, or from about 80 to about 120 cc, or from about 90 to about 110 cc. In an embodiment, the reservoir has a volume of about 100 cc. In an embodiment, the reservoir has a volume of about 101 cc.

In an embodiment, a volume of the reservoir is less than a volume of the interior compartment. The volume of the reservoir may be from about 30% to about 40% less than a volume of the compartment.

In an embodiment, the package includes a lid. The lid may have a shape selected from the group consisting of a circle, square, rectangle, triangle, quadrilateral, pentagon, hexagon, heptagon, octagon, nonagon, decagon, hexadecagon, icosagon, star, ellipse, semicircle, crescent, flower, cube, cuboid, prism, cylinder, cone, or combinations thereof. In an embodiment, the lid has a substantially square shape. The lid may be made from a material selected from the group consisting of plastic, cardboard, Styrofoam, metal, or combinations thereof. In an embodiment, the lid is a flexible plastic attached to the body by a heat seal.

In an embodiment, the body, the interior compartment, the reservoir, and the lid are all square shaped with rounded corners.

In an embodiment, the package is configured to easily convey product information to a consumer. The package may also be configured to convey nutritional information to a consumer, or to convey brand information to a consumer.

In yet another embodiment, trays are provided. The trays include a body defining first and second compartments separated by a protrusion having a height that is less than a height of the body, wherein the protrusion has a shape selected from the group consisting of a semicircle, an ellipse, a crescent, a cylinder, or combinations thereof.

In an embodiment, the first compartment is configured to house consumable products.

In an embodiment, the second compartment is configured to house a substance capable of covering the consumable produce when the tray is placed in an upright position.

In an embodiment, the first and second compartments are different sizes.

In an embodiment, the first and second compartments are different shapes.

In an embodiment, the first and second compartments are different depths.

In an embodiment, the first and second compartments are different widths.

In an embodiment, the first and second compartments are configured for self-feeding.

In an embodiment, the protrusion is formed integrally with the body. Alternatively, the protrusion may be formed as a separate component attached to the body.

In an embodiment, the protrusion is substantially semicircular in shape and has a diameter that is from about 20% to about 50% less than a length of the body, or about 30% or less than a length of the body.

In an embodiment, the protrusion is substantially semicircular in shape and has a radius that is from about 5% to about 20% less than the height of the body, or greater than about 20% of the height of the body.

In an embodiment, the protrusion extends an entire width of the body.

In an embodiment, the protrusion is configured for use as a grip.

In an embodiment, the protrusion divides the body through a center of the package. Alternatively, the protrusion may divide the body along a top third of the package.

In an embodiment, the body includes a plurality of gripping portions.

In an embodiment, the protrusion has a depth that is configured for gripping by a toddler. Alternatively, the protrusion may have a depth that is configured for gripping by a parent or caregiver.

In an embodiment, the body has a shape selected from the group consisting of a circle, square, rectangle, triangle, quadrilateral, pentagon, hexagon, heptagon, octagon, nonagon, decagon, hexadecagon, icosagon, star, ellipse, semicircle, crescent, flower, cylinder, cube, cuboid, pyramid, cone, prism, or combinations thereof. In an embodiment, the body is square shaped with rounded corners.

In an embodiment, the body is made from a material selected from the group consisting of plastic, cardboard, Styrofoam, metal, or combinations thereof.

In an embodiment, the body includes a perimeter. The perimeter can form a plane on which the package can stand.

In an embodiment, the consumable products are selected from the group consisting of pureed foods, hot dogs, fruit or vegetable pieces, meat, cheese, grains, pasta, or combinations thereof.

In an embodiment, the first compartment has a shape selected from the group consisting of a circle, square, rectangle, triangle, quadrilateral, pentagon, hexagon, heptagon, octagon, nonagon, decagon, hexadecagon, icosagon, star, ellipse, semicircle, crescent, flower, cylinder, cube, cuboid, pyramid, cone, prism, or combinations thereof. In an embodiment, the first compartment has a square shape with rounded corners.

In an embodiment, the first compartment extends substantially an entire length of the body.

In an embodiment, the first compartment extends substantially an entire width of the body.

In an embodiment, the first compartment has a volume ranging from about 100 to about 180 cc.

In an embodiment, the first compartment has a volume ranging from about 110 to about 170 cc, or from about 120 to about 160 cc, or from about 130 to about 150 cc. In an embodiment, the first compartment has a volume of about 140 cc.

In an embodiment, the first compartment is configured for self-feeding of a toddler.

In an embodiment, the second compartment has a shape selected from the group consisting of a circle, square, rectangle, triangle, quadrilateral, pentagon, hexagon, heptagon, octagon, nonagon, decagon, hexadecagon, icosagon, star, ellipse, semicircle, crescent, flower, cube, cuboid, prism, cylinder, cone, or combinations thereof. In an embodiment, the second compartment has a square shape with rounded corners.

In an embodiment, the second compartment extends substantially an entire length of the body.

In an embodiment, the second compartment extends substantially an entire width of the body.

In an embodiment, the second compartment is configured to hold at least one consumable product.

In an embodiment, the second compartment is configured for multiple uses. The multiple uses may include use as a storage area for a preservative and use as a serving area for a dipping sauce. The multiple uses may also include use as a storage area for brine and use as a serving area for condiments.

In an embodiment, the second compartment is configured to house a liquid selected from the group consisting of water, brine, pickling liquid, oil, juice, syrup, or combinations thereof. The second compartment may also be configured to house solids selected from the group consisting of salt, powdered spices, whole spice, sugar, or combinations thereof. In an embodiment, the second compartment is configured to house preservatives.

In an embodiment, the second compartment is configured to house a first substance during storage and a second substance during use by a consumer.

In an embodiment, the second compartment has a volume ranging from about 70 to about 130 cc, or from about 80 to about 120 cc, or from about 90 to about 110 cc. In an embodiment, the second compartment has a volume of about 100 cc. In an embodiment, the second compartment has a volume of about 101 cc.

In an embodiment, a volume of the second compartment is less than a volume of the first compartment. A volume of the second compartment may be from about 30% to about 40% less than a volume of the first compartment.

In an embodiment, the tray includes a lid. The lid has a shape selected from the group consisting of a circle, square, rectangle, triangle, quadrilateral, pentagon, hexagon, heptagon, octagon, nonagon, decagon, hexadecagon, icosagon, star, ellipse, semicircle, crescent, flower, cube, cuboid, prism, cylinder, cone, or combinations thereof. In an embodiment, the lid has a substantially square shape. The lid may be made from a material selected from the group consisting of plastic, cardboard, Styrofoam, metal, or combinations thereof. In an embodiment, the lid is a flexible plastic attached to the body by a heat seal.

In an embodiment, the body, the first compartment, the second compartment, and the lid are all square shaped with rounded corners.

In an embodiment, the package is configured to easily convey product information to a consumer. The package may also be configured to convey nutritional information to a consumer, or to convey brand information to a consumer.

In yet another embodiment, packaged food products are provided. The packaged food products include a body having first and second compartments separated by an arched protrusion, the first compartment housing a consumable product and the second compartment housing a substance selected from the group consisting of a liquid, powder, puree, sauce, spice, solid, flake, oil, chunk, or combinations thereof. The packaged food products further include a lid covering the body so as to enclose the consumable product and substance within the body.

In an embodiment, the consumable products are selected from the group consisting of pureed foods, hot dogs, fruit or vegetable pieces, meat, cheese, grains, pasta, or combinations thereof.

In an embodiment, the second compartment is configured to house a liquid selected from the group consisting of water, brine, pickling liquid, oil, juice, syrup, or combinations thereof. The second compartment may also be configured to house solids selected from the group consisting of salt, powdered spices, whole spice, sugar, or combinations thereof. In an embodiment, the second compartment is configured to house preservatives.

In still yet another embodiment, methods for marketing consumable products without loss of product quality are provided. The methods include providing a consumable product package and placing the consumable product package upright on a retail shelf such that at least a portion of the substance in the reservoir drains into the interior compartment. The product package includes a body defining (i) an interior compartment configured to house a consumable product, (ii) a reservoir configured to house a substance capable of covering the consumable product when the package is placed in an upright position, and (iii) a protrusion separating the interior compartment and the reservoir, and a lid covering the body.

In another embodiment, methods for storing consumable products without loss of product quality are provided. The methods include providing a consumable product package and storing the consumable product package upright such that at least a portion of the substance in the reservoir drains into the interior compartment. The product package includes a body defining (i) an interior compartment configured to house a consumable product, (ii) a reservoir configured to house a substance capable of covering the consumable product when the package is placed in an upright position, and (iii) a protrusion separating the interior compartment and the reservoir, and a lid covering the body.

In an embodiment, the lid includes an indicia. The indicial may be selected from the group consisting of brand information, product information, nutritional information, a graphic, a picture, a barcode, or combinations thereof.

It is an advantage of the present disclosure to provide improved consumable product containers.

It is also an advantage of the present disclosure to provide consumable product containers that are efficient to use to store consumable products.

It is an advantage of the present disclosure to provide consumable product containers that may be stored in one position and used in another to serve the consumable product within.

It is another advantage of the present disclosure to provide consumable product containers that can have at least one multipurpose reservoir.

It is yet another advantage of the present disclosure to provide consumable product containers that are aesthetically pleasing.

It is another advantage of the present disclosure to provide consumable product containers that improve marketability of the containers.

It is a further advantage of the present disclosure to provide packages that are easy to display on a retail shelf.

It is another advantage to provide improved methods for displaying packages on a retail shelf.

It is a further advantage of the present disclosure to provide consumable product containers that are easily gripped by caretakers for handling children's foods.

Yet another advantage of the present disclosure is to provide consumable product containers that are easily gripped by children for self-feeding.

It is a further advantage of the present disclosure to provide a package that improves preservation of consumable food products stored therein throughout the life of the package from shelf display to consumption.

Additional features and advantages are described herein, and will be apparent from the following Detailed Description and the figures.

DETAILED DESCRIPTION

Figure 1:
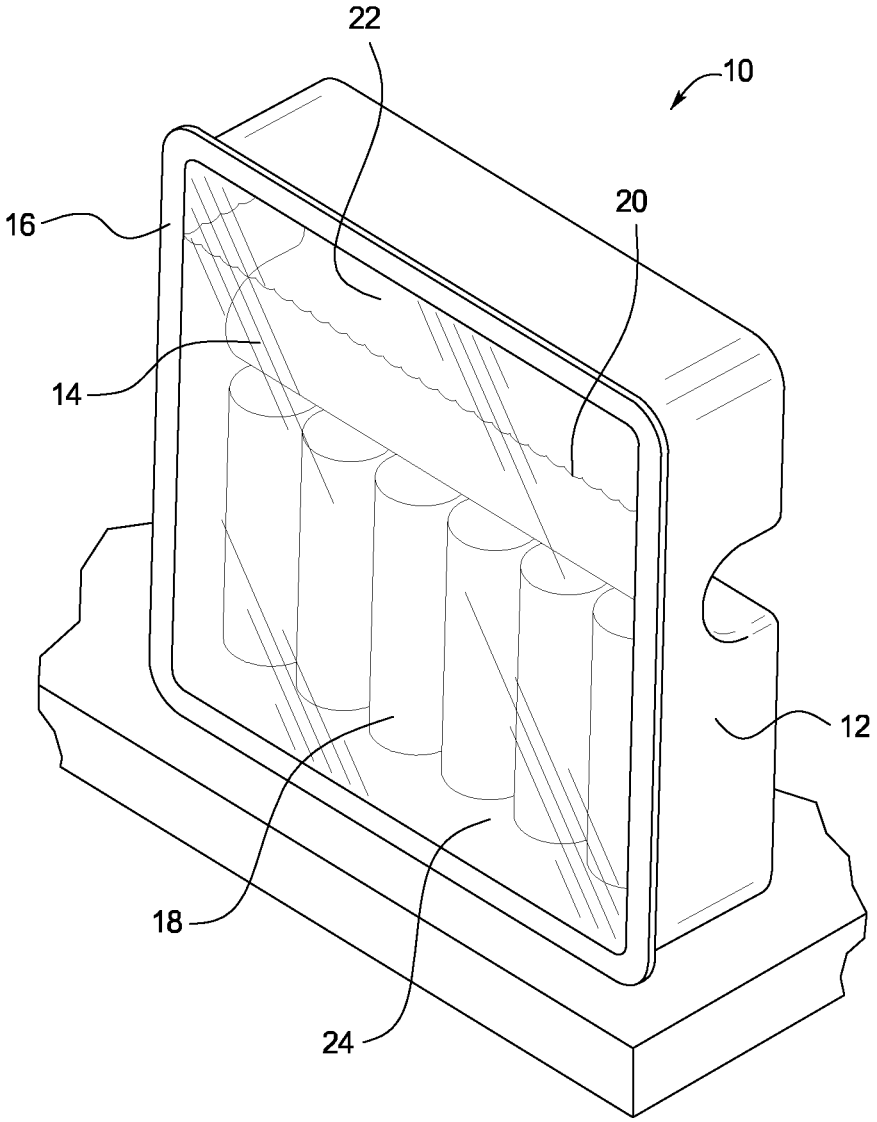
FIG. 1 illustrates a perspective view of a package in accordance with an embodiment of the present disclosure.

The present disclosure provides packages or containers for housing consumable products. The packages may be designed to facilitate preservation and maintain quality of a consumable product while still allowing the consumable products to be used in such a way as to promote self-feeding by an individual without a loss of marketing or advertising potential. In a general embodiment, packages of the present disclosure include a compartment and at least one reservoir designed to allow a substance, such as brine, juice, or sauce, to cover the products while the packages are displayed on a shelf. The compartment and reservoir are separated by a protrusion. The packages may also be custom designed for ease of use by toddlers and/or their caregivers by providing at least one convenient grip portion formed from the protrusion that separates the compartment and reservoir.

In a general embodiment, packages of the present disclosure include a body that defines a perimeter and at least one interior compartment. The compartment may be divided into two parts by a raised portion or protrusion of the body. The at least two parts may include, for example, a compartment for storing consumable food products and a reservoir. The at least two parts may also include two separate compartments. In one embodiment, the compartments each store food products that are meant to be combined before consumption. In another general embodiment, packages of the present disclosure include a body that defines a perimeter and at least one separate interior compartment that can serve as a reservoir. In a third general embodiment, the package is a tray with two compartments defined by the body of the tray. One of the compartments is configured to house consumable products and the other compartment is configured to function as a reservoir to hold substances to cover or mix with the consumable products.

Packages of the present disclosure are designed to house consumable products. Consumable products housed in the packages may be any consumable products including, for example, baby foods, snack foods, full meals, side meals, etc. In an embodiment, the packages house foods for children (e.g., infants, toddlers, pre-schoolers, etc.) including, for example, meats, fruits, vegetables, grains, cereals, cheese, pastas, etc. The consumable products may be pureed foods, finger foods or may be designed to be consumed using utensils. The teachings of the present disclosure, therefore, are not dependent upon the consumable products being of any particular type so long as the products fit within the packages described herein.

The bodies of the packages of the present disclosure may be made from a molded plastic material such as, for example, polyethylene, polypropylene, or the like, or combinations thereof. The bodies may be formed using conventional thermoforming or molding processes including, but not limited to, injection molding, injection blow molding and extrusion blow molding. Alternatively, the bodies may be manufactured from non-plastic materials including, but not limited to, cardboard, metal, styrofoam, etc. Further, at least a portion of the bodies can be either transparent or translucent so that a consumer can readily discern what types of products are housed in the compartments of the packages. Alternatively, at least a portion of the bodies may be opaque. In an embodiment wherein a lid is provided, the lid may be manufactured from a same or different material as the body and may be translucent while the body is opaque, or vice versa.

In an embodiment, and as shown in FIG. 1, a package 10 for storing consumable products is provided. Package 10 includes body 12 that defines an interior compartment 24. Although body 12 of package 10 is illustrated as being substantially square in shape, body 12 of package 10 may define any shape that is known in the art. For example, body 12 may be a circle, square, rectangle, triangle, quadrilateral, hexagon, nonagon, decagon, hexadecagon, icosagon, star, ellipse, semicircle, crescent, flower, cylinder, cube, cuboid, pyramid, cone, prism, etc., so long as body 12 is capable of housing a consumable product within an interior compartment. For ease of reference, and with this embodiment, body 12 will be discussed as being a square body 12 with rounded corners.

Body 12 is also not limited to any particular size so long as consumable products may be contained therein and may be easily handled by a toddler or a caregiver of a toddler. The skilled artisan will appreciate that the dimensions of package 10 may vary as desired or in accordance with manufacturing specifications or in accordance with the size and shape of the consumable products contained therein.

Package 10 is not limited to any particular size or shape so long as consumable products may be contained in interior compartment 24 and package 10 may stand substantially upright on its own, as will be discussed further below. In an embodiment, package 10 houses consumable products designed for children (e.g., infants, toddlers, pre-schoolers), and should be sized accordingly. For example, package 10 should not be so large that a child is unable to easily hold package 10 by his or herself. This will aid in teaching a child or other individual in need to self-feed.

Compartment 24 may be the same shape as body 12, reservoir 22, and lid 26, or it may be a different shape. It may be a circle, square, rectangle, triangle, quadrilateral, hexagon, nonagon, decagon, hexadecagon, icosagon, star, ellipse, semicircle, crescent, flower, cylinder, cube, cuboid, pyramid, cone, prism, etc. It may also be any size, so long as container 24 is capable of housing a consumable product within an interior compartment. For example, compartment 24 may extend substantially the entire length or width of the body. It may also encompass only a small portion of the body. In an embodiment, compartment 24 has a rectangular shape that has a size that is slightly longer than the length of a food product to be contained therein. For example, a rectangular shape of compartment 24 would allow a plurality of food products of the same length to be contained with compartment 24 and would advantageously prevent shifting or movement of the plurality of food products to a different portion of body 12.

In addition, interior compartment 24 of body 12 can have any size and shape that allows a toddler to easily self-feed. For example, the interior compartment may be substantially square with rounded edges, a shape that will allow a toddler to reach into body 12 to remove consumable products 18 housed therein to self-feed. Since the dexterity of toddlers is limited or not fine-tuned, a toddler may have an easier time removing food from body 12 if the shape of the body is similar to the shape of the food stored within. For example, a substantially square or rectangular package would be useful for storing stick-shaped or cube-shaped food. In an embodiment, the interior compartment has a substantially square shape.

Interior compartment 24 should be sufficiently shallow so as to facilitate self-feeding. Interior compartment 24 can have a volume ranging, for example from about 100 to about 180 cc. The volume could also range from, for example, about 110 to about 170 cc, about 120 to about 160 cc, about 130 to about 150 cc, or the like. In one embodiment, interior compartment 24 will have a volume of about 140 cc. The skilled artisan will, however, appreciate that the volume of interior compartment 24 may vary so as to facilitate the housing of a wide variety of consumable goods within the compartment.

Body 12 may include any number of compartments 24, which will be limited only by the size of package 10. For example, in an embodiment, body 12 includes a number of compartments 24 selected from the group consisting of two, three, four, etc.

Body 12 also contains a reservoir 22, as shown in FIG. 1. Reservoir 22 may be a separate compartment as illustrated in FIGS. 1-4 or it may be a partitioned off a section of compartment 24. For ease of reference, and with this embodiment, reservoir 22 will be discussed as illustrated in FIGS. 1-4.

Reservoir 22 may have any shape, such as circle, square, rectangle, triangle, quadrilateral, hexagon, nonagon, decagon, hexadecagon, icosagon, star, ellipse, semicircle, crescent, flower, cylinder, cube, cuboid, pyramid, cone, prism, etc. The reservoir may also extend substantially the entire length or width of the body of the package. In contrast, it may only extend over a small portion of the same.

Reservoir 22 can also be any depth. However, reservoir 22 should have a size, shape, and depth that allows for it to hold a substance 20, such as, for example, brine. The reservoir would provide extra area beyond compartment 24 to hold the substance in such a way as to ensure full coverage of the consumable product stored in compartment 24 when package 10 is standing vertically, such as on a store shelf, as pictured in FIG. 1.

Figure 2:
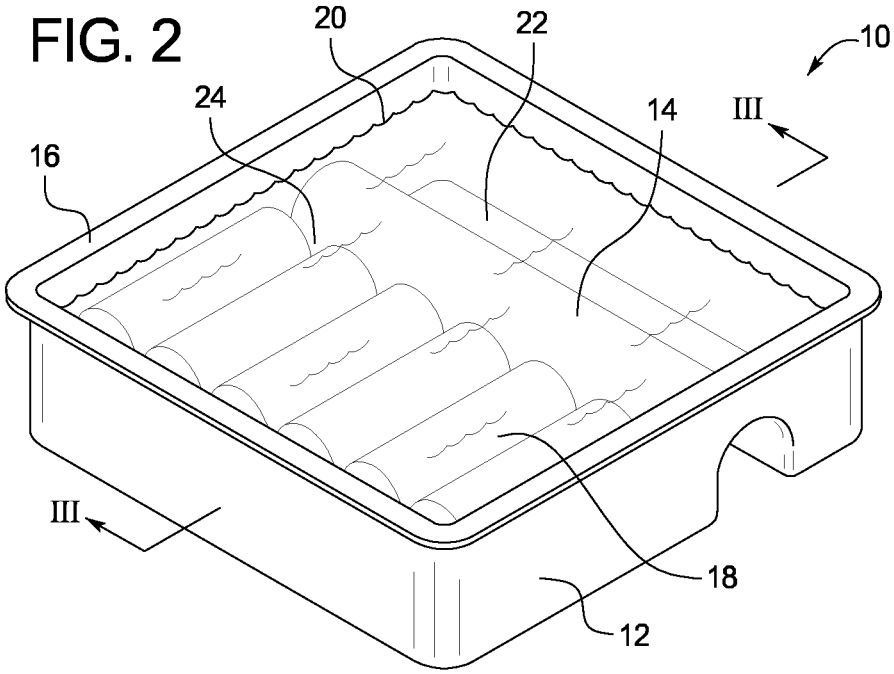
FIG. 2 illustrates a perspective view of the package of FIG. 1 in accordance with an embodiment of the present disclosure.
Figure 3:
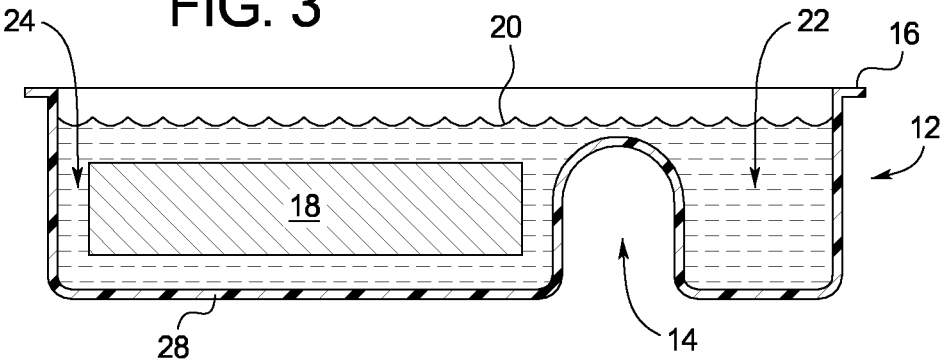
FIG. 3 illustrates a cross section view along line III-III of the package in FIG. 1 in accordance with an embodiment of the present disclosure.
Figure 4:
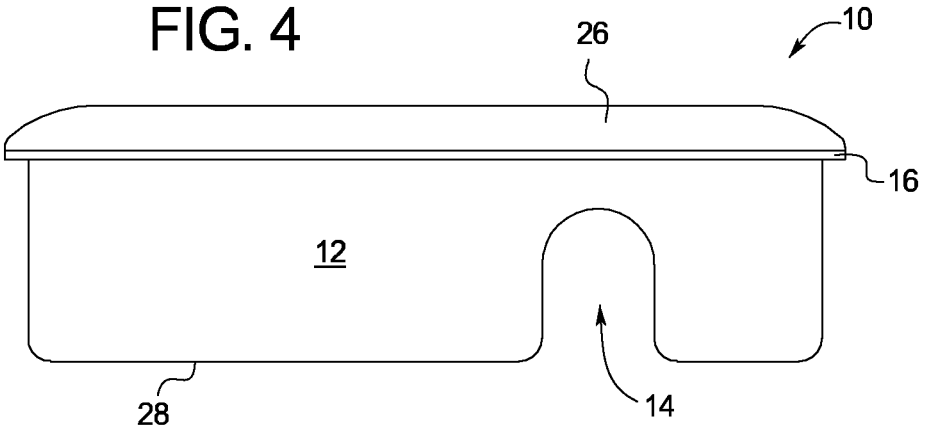
FIG. 4 illustrates a horizontal side view of the package of FIG. 1 in accordance with an embodiment of the present disclosure.

In an embodiment, reservoir 22 has a substantially square shape to match a similar shape of compartment 24. In another embodiment, reservoir 22 is differently shaped from compartment 24 but still allows liquid, powder, flakes, oils or another substance placed in reservoir 22 to fully cover compartment 24 when package 10 is placed upright. This allows the consumable products to derive the benefit of the substance placed in reservoir 22 when package 10 is horizontal as shown in FIGS. 2-4.

Full coverage of compartment 24 by a substance from reservoir 22 may be necessary to improve and maintain the quality of the consumable product 18 kept in compartment 24. For example, if meat sticks were kept in compartment 24, brine from reservoir 22 would completely cover the sticks when package 10 is placed upright in the position shown in FIG. 1. The upright position may be beneficial for shelf placement in stores to improve the marketing and advertising potential of package 10. The brine would prevent the sticks from oxidizing or drying out on the shelf before the sticks are served to the consumer. In this way, consumable product 18 would remain fully covered, even if a loss of substance 20 occurred, for example, as would occur through evaporation of a preserving liquid. Any gap in coverage would be in reservoir 22, not compartment 24.

Reservoir 22 could hold any substance intended to cover consumable products in compartment 24. For example, it may be desirable to have the consumable products in compartment 24 to be fully covered with sauces, juices, flavorings, sugars or spice mixes, as well as preservatives, while package 10 is stored upright on a shelf.

In an embodiment, reservoir 22 contains a substance that when package 10 is placed upright, fully covers compartment 24, but when package 10 is opened, reservoir 22 is able to be used to hold other substances, such as dipping sauces or condiments or a complimentary side dish to accompany consumable product 18. The skilled artisan will also appreciate that reservoir 22 will have as large a volume as necessary to hold the substances that can cover the consumable goods. For example, the reservoir may have a volume from about 70 to about 130 cc, or about 80 to about 120 cc, or about 90 to about 110 cc. In an embodiment, the reservoir volume will be about 100 or 101 cc. The volume of the reservoir may be as great, or greater than that of compartment, but it need not be so. For example, the volume of reservoir 22 may be 30 or 40% less than the volume of compartment 24.

Body 12 may include any number of reservoirs 22, which will be limited only by the size of package 10. For example, in an embodiment body 12 includes a number of reservoirs 22 selected from the group consisting of two, three, four, etc.

Reservoir 22 may be separated from compartment 24 by a protrusion 14 as shown in FIGS. 1-4. Protrusion 14 may be formed as an integral portion of body 12. It could also be formed as a separate, non-integral, barrier between compartment 24 and reservoir 22.

Protrusion 14 can be any shape known in the art that would function to keep consumable products stored in interior compartment 24 contained in the compartment and not shift into the reservoir, as mentioned above with respect to the shape of compartment 24. For example, protrusion 14 could be a rounded arch, or a pointed pyramid, or a solid raised square block portion. It may also be a half-circle, a semicircle, an ellipse, a crescent, a triangle, a square, a quadrilateral, a rectangle, a cylinder, a cube, a cuboid, a pyramid, a cone, a prism, etc. In an embodiment, package 10 incorporates multiple protrusions 14.

In an embodiment, protrusion 14 has a substantially semicircle shape. Such a shape provides the benefit of a rounded portion on the bottom of body 12 that aids in gripping package 10, as will be discussed further below. A semicircular protrusion 14 may have a diameter that is from about 20% to about 50% less than the length of the body of package 10. In an embodiment, the diameter is 30% or less than the length of package 10. The radius of the semicircle may be from about 5% to about 20% less than the height of body 12. It may also be greater than about 20% of the height of body 12. In an embodiment, the radius is from about 20% to about 50% less than the length of body 12.

Protrusion 14 can serve as a grip portion for an individual learning to self-feed or for a caretaker assisting an individual learning to self-feed. The function of protrusion 14 as a grip may be especially useful in embodiments wherein the consumable product housed by package 10 is a finger food that a child can consume without the use of utensils. The depth of protrusion 14 would be understood by the skilled artisan to be any depth that would be comfortable for a caretaker or individual learning to self-feed to easily hold. For example, protrusion 14 may be about as wide as is comfortable for gripping for an average adult-sized hand. Protrusion 14 may instead be about as wide as is comfortable for gripping for an average toddler-sized hand. In an embodiment, the package has a plurality of gripping portions.

Protrusion 14 may be of varying heights. In an embodiment, the height of protrusion 14 is lower than the height of body 12 in order to facilitate the flow of substances from reservoir 22 to compartment 24. Protrusion 14 may also be located anywhere on body 12. For example, it may divide the body down the center, or through the top third. Protrusion 14 may also extend the entire length and width of body 12.

In an embodiment, package 10 may be stood upright for storage or display as shown in FIG. 1. For optimum packaging and shipping to a consumer or to retail stores, it is beneficial that package 10 is able to stand substantially upright. Further, it is advantageous for marketing purposes to display package 10 on a store shelf in a substantially upright position such that a consumer is able to identify product information on the front of package 10, and a caregiver and/or an individual learning to self-feed may easily view the colors, shapes, and information on package 10.

For example, as shown in FIG. 3, a bottom surface 28 of body 12 may, in combination with perimeter 16, form a plane on which package 10 stands. In other words, as long as package 10 defines a plane on which package 10 can rest, the shape of perimeter 16 and/or compartment 24 or reservoir 22 is immaterial. In an embodiment, package 10 may rest in a substantially vertical or upright position or may rest in a position that tilts toward or away from a consumer, depending on the shape of package 10. Regardless of the shape of package 10, if intended to rest on a side surface, package 10 must be able to rest in a stable manner on the plane. In other words, package 10 must be constructed and arranged so that it will not easily fall over when filled with consumable products.

In another embodiment, package 10 may be configured to hang vertically from a display rack in a retail store. Body 12 may define a hook (not illustrated) that is so constructed and arranged to receive a hanger that allows package 10 to hang from a display rack. The shape and size of the hook is not critical. For example, in an embodiment, the hook may be a hole in a top portion of body 12. The hook may be entirely defined by body 12 such that the hook does not form part of perimeter 16.

Alternatively, however, perimeter 16 may include an integral hook (not illustrated) that is so constructed and arranged to form a portion of perimeter 16. In other words, the integral hook may be formed continuously with a portion of perimeter 16 such that it shares a boundary with perimeter 16. For example, in an embodiment where package 10 generally has a square shape, the hook may form a portion of perimeter 16 located at a top of package 10 and may have a curved configuration that functions as a hook but looks like flower growing out of the square. The skilled artisan will appreciate that the integral hook is not limited to any particular size or shape so long as the integral hook allows a display hanger to pass therethrough to hang package 10.

In addition to standing substantially upright and hanging, package 10 may also be configured to lay substantially flat on a surface, as shown in FIGS. 2-4. In an embodiment, body 12 is substantially flat and allows package 10 to lay on a flat surface.

Package 10 may also include a lid 26 that is sized and shaped to fit with body 12 as shown in FIG. 4. Lid 26 is not limited to any particular shape or size, so long as lid 26 is capable of sealingly fitting to body 12 to prevent loss or contamination of a consumable product housed therein. In this manner, lid 26 may be mated with body 12 by snap-fitting, pressure-fitting, friction fitting, heat-sealing etc. Lid 26 may be fitted to body 12 in a resealing manner so that each time lid 26 is removed from body 12, it may be placed on body 12 again in a sealed manner.

Lid 26 can be any form of removable closure. The lids of packages of the present disclosure may be made from a molded plastic material such as, for example, polyethylene, polypropylene, or the like, or combinations thereof. The lids may be formed using conventional thermoforming or molding processes including, but not limited to, injection molding, injection blow molding and extrusion blow molding. Alternatively, the lids may be manufactured from non-plastic materials including, but not limited to, cardboard, metal, styrofoam, etc. Further, at least a portion of the lids can be either transparent or translucent so that a consumer can readily discern what types of products are housed in the compartments of the packages. Alternatively, at least a portion of the lids may be opaque. In an embodiment, the lid is made of a flexible plastic that is sealed to the top portion of the body and may be attached by heat sealing.

Lid 26, like body 12, may be any shape known in the art. For example, it may be a circle, square, rectangle, triangle, quadrilateral, hexagon, nonagon, decagon, hexadecagon, icosagon, star, ellipse, semicircle, crescent, flower, cylinder, cube, cuboid, pyramid, cone, prism, etc. In an embodiment, lid 26 is substantially square shaped.

It may also be any color known in the art. The color can be chosen to improve the marketing and advertising potential of the consumable food product. For example, lid 26 can be the same color as body 12 or a different color. The skilled artisan will appreciate that the color choice can be used consistently to support the manufacturing brand. The skilled artisan will also appreciate that the color chosen may be a color that will help attract attention to the product on the shelf.

Body 12 and lid 26 may be decorated in any way that would attract positive attention to the product by a consumer of the consumable goods within package 10. Such decorations could include pictures of the consumable product, company logos or trademarks, or any picture or decoration that would appeal to individuals interested in the consumable goods in package 10; including, for example, toddlers and/or their caregivers. The decoration and color of lid 26 and body 12 can also provide indicia to caregivers that are indicative of the type of food contained in body 12 to help them easily piece together a nutritional meal for a toddler or another individual learning to self-feed. The decoration may also include product information and nutritional information.

In an embodiment, methods for marketing consumable products without loss of product quality are provided. The methods include providing a package including (i) a body defining an interior compartment configured to house a consumable product and (ii) the body also defining a reservoir configured to house a preserving, flavoring or storage substance such as juice, sauce, spices, or brine and (iii) a protrusion formed from the body of the package separating the interior compartment and reservoir defined by the body. The methods further include placing the package on a retail shelf. When the package is placed on the shelf, the substance in the reservoir fully covers the defined interior compartment and any consumable products therein.

In another embodiment, methods for marketing consumable products can be practiced by hanging the package from a hook in a retail establishment.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A package, comprising:

a body having a top end, a bottom wall, and a plurality of sidewalls extending from the bottom wall to the top end so as to cooperate with the bottom wall to define an interior compartment, the bottom wall of the body having a protruding portion protruding into the interior compartment to divide the interior compartment into a food storage compartment and a liquid storage reservoir, an entirety of the protruding portion being spaced from the top end of the body;

a solid food positioned within the food storage compartment;

a volume of a liquid substance positioned within both the food storage compartment and the liquid storage reservoir; and a lid secured to the top end of the body in a spaced relationship to the protruding portion of the bottom wall to secure the solid food in the food storage compartment while allowing the liquid substance to flow between the food storage compartment and the liquid storage reservoir, wherein the volume of the liquid substance positioned in both the food storage compartment and the liquid storage reservoir is sufficient to cover an entirety of the solid food when the body is oriented with the liquid storage reservoir positioned above the food storage compartment.

2. The package of claim 1, wherein each of the liquid storage reservoir and the food storage compartment has a volume, and wherein the volume of the liquid storage reservoir is less than the volume of the food storage compartment.

3. The package of claim 2, wherein the protruding portion extends from one sidewall to an opposing sidewall.

4. The package of claim 3, wherein the protruding portion is upside-down U-shaped.

5. The package of claim 1, wherein each of the liquid storage reservoir and the food storage compartment has a volume, wherein the volume of the food storage compartment is in a range from 100 cc to 180 cc, and wherein the volume of the liquid storage compartment is in a range from 70 cc to 130 cc.

6. The package of claim 1, wherein the liquid substance is brine.

* * * * *